US008641008B2

(12) United States Patent
Schiavone et al.

(10) Patent No.: US 8,641,008 B2
(45) Date of Patent: Feb. 4, 2014

(54) METHOD FOR CONTROLLING THE POSITION OF AN ELECTROMECHANICAL ACTUATOR FOR RECIPROCATING COMPRESSOR VALVES

(75) Inventors: Massimo Schiavone, Carrara (IT); Andrea Raggi, Lerici (IT); Carlo Rossi, Bologna (IT)

(73) Assignee: Dott. Ing. Mario Cozzani S.r.l., Arcola (IT)

( * ) Notice: Subject to any disclaimer, the term of this patent is extended or adjusted under 35 U.S.C. 154(b) by 499 days.

(21) Appl. No.: 12/989,836

(22) PCT Filed: Apr. 27, 2009

(86) PCT No.: PCT/EP2009/055041

§ 371 (c)(1),
(2), (4) Date: Nov. 19, 2010

(87) PCT Pub. No.: WO2009/133058

PCT Pub. Date: Nov. 5, 2009

(65) Prior Publication Data

US 2011/0079739 A1 Apr. 7, 2011

(30) Foreign Application Priority Data

Apr. 30, 2008 (IT) ..... GE2008A0036

(51) Int. Cl.
*F16K 31/02* (2006.01)

(52) U.S. Cl.
USPC ..... 251/129.04; 251/129.1; 251/129.16; 335/256; 335/257; 335/266; 335/277

(58) Field of Classification Search
USPC ..... 251/129.04, 129.09–129.1, 129.16; 123/90.11; 335/256, 257, 266, 277
See application file for complete search history.

(56) References Cited

U.S. PATENT DOCUMENTS

| | | | | |
|---|---|---|---|---|
| 4,392,632 | A * | 7/1983 | Gast et al. | 251/129.1 |
| 5,494,219 | A * | 2/1996 | Maley et al. | 251/129.1 |
| 5,748,433 | A * | 5/1998 | Schrey et al. | 123/90.11 |
| 5,833,209 | A | 11/1998 | Steinrueck | |
| 5,988,985 | A | 11/1999 | Steinrueck | |
| 6,003,481 | A * | 12/1999 | Pischinger et al. | 123/90.11 |
| 6,066,999 | A * | 5/2000 | Pischinger | 335/266 |
| 6,257,182 | B1 * | 7/2001 | Hara et al. | 123/90.11 |
| 6,976,667 | B2 * | 12/2005 | Muraji | 251/129.16 |
| 7,021,255 | B2 * | 4/2006 | Degner et al. | 123/90.11 |
| 7,069,886 | B2 * | 7/2006 | Morin | 123/90.11 |
| 7,107,945 | B2 * | 9/2006 | Fuwa | 251/129.16 |

(Continued)

OTHER PUBLICATIONS

International Search Report for PCT/EP2009/055041.

(Continued)

*Primary Examiner* — John Bastianelli
(74) *Attorney, Agent, or Firm* — Stites & Harbison PLLC; Marvin Petry

(57) ABSTRACT

Method for controlling the position of an electromechanical actuator for reciprocating compressor valves. The actuator includes a member (302) movable in a direction parallel to the direction for opening and closing the obturator of the valve (12), between a position corresponding to the closed position and a position corresponding to the open position of the obturator (11). The member (302) is provided with a mechanism (322) able to act on the obturator (11) and with a magnetizable portion (312) co-operating with two electromagnets (102, 202) and being arranged in equilibrium between the latter via a suitable mechanism.

9 Claims, 2 Drawing Sheets

(56) References Cited

U.S. PATENT DOCUMENTS

Figure 1:
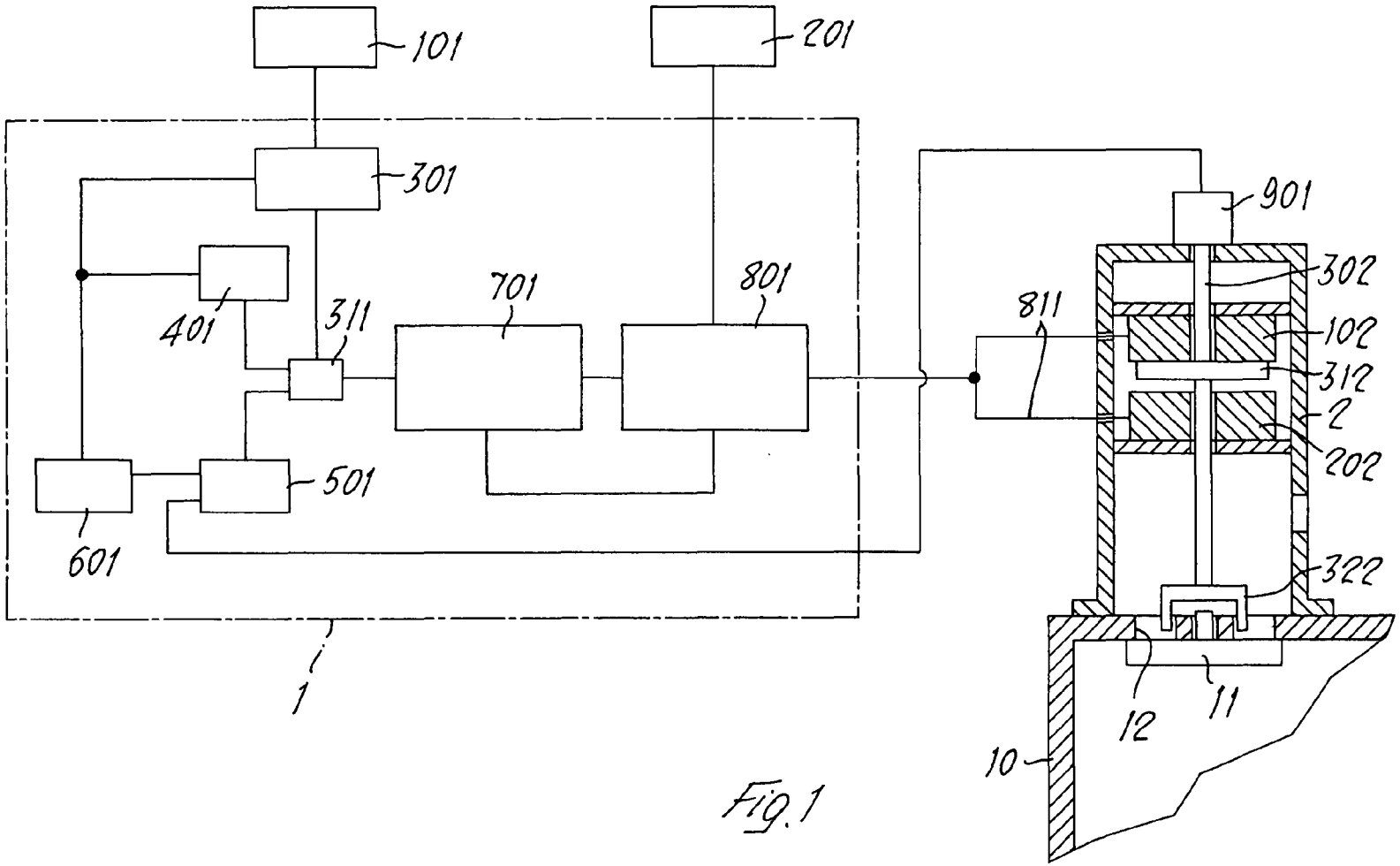

| | | | | |
|---|---|---|---|---|
| 7,156,057 | B2 * | 1/2007 | Lecrivain et al. | 251/129.16 |
| 2002/0025263 | A1 | 2/2002 | Graziani et al. | |
| 2004/0083993 | A1 * | 5/2004 | Seale et al. | 251/129.1 |
| 2008/0035093 | A1 * | 2/2008 | Sedda et al. | 123/188.4 |
| 2009/0238700 | A1 | 9/2009 | Schiavone et al. | |

OTHER PUBLICATIONS

Written Opinion of the International Searching Authority for PCT/EP2009/055041.

* cited by examiner

METHOD FOR CONTROLLING THE POSITION OF AN ELECTROMECHANICAL ACTUATOR FOR RECIPROCATING COMPRESSOR VALVES

The present invention relates to valves, and in particular to valves for reciprocating compressors; more particularly, the invention relates to a method for controlling an electromechanical actuator for said valves.

Patent application No. WO-A-2008 000698 filed by the same Applicant describes an apparatus for continuously regulating the delivery of a reciprocating compressor, which has at least one compression chamber slidably housing a piston means movable with a reciprocating motion, said chamber being provided with at least one intake valve for the fluid to be compressed and at least one discharge valve for the compressed fluid, said discharge valve being connected to a tank for storing the compressed fluid, and said intake valve being provided with displacement means able to act on the obturator of the said valve, said displacement means being movable in a direction perpendicular to the plane of said obturator and co-operating with actuator means movable in the said direction with a reciprocating motion via suitable operating means; said operating means allow control of the speed of displacement of said actuator means in both directions of their movement; there being provided means for detecting the position of the said actuator means, means for detecting the position of the piston inside the compression chamber and means for detecting the pressure inside the tank, said detection means and said means for operating the actuator means being connected to a central processing unit.

The actuator is used to control closing of the intake valve with respect to the closing point during maximum delivery. The gas entering the cylinder flows back into the intake line in an amount proportional to the section of the compression stroke during which the intake valves are kept open.

During operation the control unit receives at its input a large number of signals (enable, start-up, positioning, open position) which are processed in order to determine the type of control to be used.

In order to operate the movable parts of said actuator two electromagnets are provided, their voltage being regulated so as to control the position of the aforementioned movable parts.

When using the electromechanical actuator it is extremely difficult to control the movement of the movable part, owing to the fact that there are no stable points of equilibrium in the vicinity of the contact points. Moreover, it is necessary to ensure a low transition time and the power used by the actuator must be negligible compared to that saved by the compressor.

The equilibrium positions, namely the points of intersection between the force of the springs and the force due to the magnets, in the vicinity of the electromagnets are unstable. In fact, a disturbance which decreases the distance accelerates the armature against the magnet since the magnetic force depends on the square of the distance, while the force of the springs depends in a linear manner on the position. In this situation high contact speeds are obtained if the current is not rapidly reduced. A movement away from the magnet will reduce the force, and, if the current is not suitably controlled, the armature will assume the equilibrium position close to the intermediate position.

Moreover, when the armature approaches the magnet, the time constant of the electrical part is comparable to the transition times, so that the effect of the inputs on the outputs is limited.

The object of the present invention is to provide a method which allows control of the position of the movable parts of the actuator, while limiting the contact speed and optimising the movement of the actuator itself in relation to the functional requirements of the valve.

The present invention therefore relates to a method for controlling the position of an electromechanical actuator for valves of reciprocating compressors, which comprises a member movable in a direction parallel to the direction of opening and closing of the obturator means of said valve between a position corresponding to the closed position and a position corresponding to the open position of the said obturator means, said member being provided with a magnetisable portion co-operating with two solenoids and being arranged in equilibrium between them via suitable means, characterized by the following operational steps of:

a) release for opening: the solenoids are energised so as to allow separation of the movable member portion from one of the two solenoids and cause its displacement towards the other solenoid;

b) current-controlled opening: the movable member, as a result of the action of the solenoids, moves towards the position for opening the valve obturator means;

c) position-controlled opening: the current in the solenoids is regulated so as to brake the movable member during the final section of the stroke;

d) retention in open position: the movable member is retained in the position for opening the valve obturator means for a given time interval;

e) release for closure: the solenoids are energised so as to allow separation of the movable member portion from one of the two solenoids and cause its displacement towards the other solenoid;

f) current-controlled closure: the movable member, as a result of the action of the solenoids, moves towards the position for closing the valve obturator means;

g) position-controlled closure: the current in the solenoids is regulated so as to brake the movable member during the final section of the stroke;

h) retention in closed position: the movable member is retained in the position for closing the valve obturator means until a new transition signal is generated, for execution of step a) again.

The invention also relates to a device able to implement the method described above, comprising a processing unit connected to means for detecting the position of the movable member of the said actuator, and a detector for detecting the strength of the current flowing inside the two solenoids, said processing units being characterized by: a module for inputting the enable and start-up signals; a non-volatile memory module storing the program for processing the data acquired and the predefined reference values, a module for generating the trajectory of the said movable member, a module for adjusting the position of the said movable member, a module for regulating the current which controls a power supply section connected to a power supply input and interfaced with the means for detecting the strength of the current flowing in the said solenoids.

Figure 2:
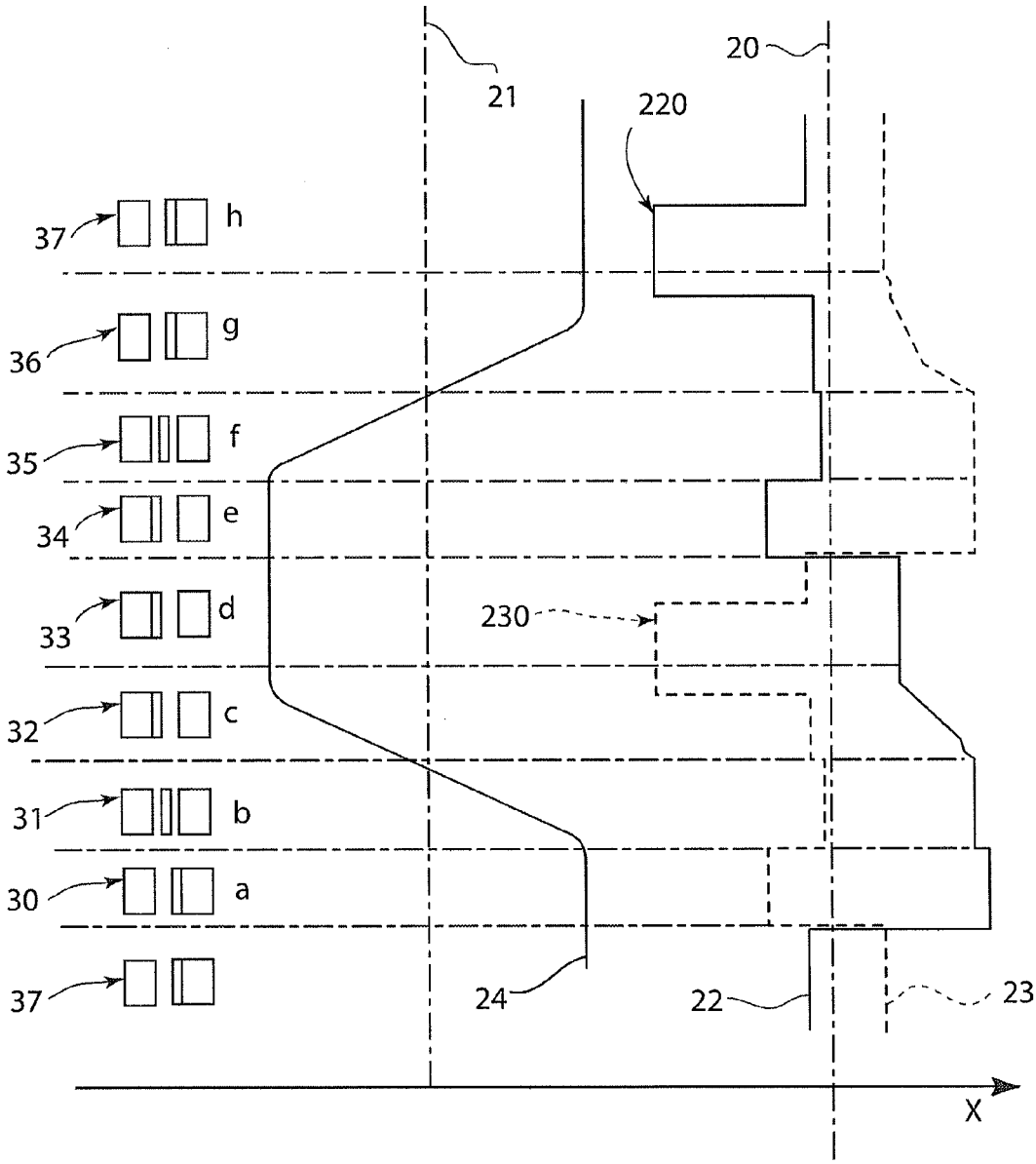

Further characteristic features will emerge from the following detailed description of an embodiment of the present invention provided, by way of a non-limiting example, with reference to the series of accompanying drawings in which:

FIG. 1 is a schematic block diagram which shows the device for controlling the actuator according to the present invention; and FIG. 2 is a schematic diagram which shows the sequence of steps of the method according to the present invention.

In FIG. 1 the number 1 denotes the device for controlling the actuator according to the present invention; said device is a microprocessor provided with a module 101 for inputting the enable, start-up and open-locking signals, which communicates with a logic memory module 301, i.e. a module storing the program which manages execution of the method according to the invention. The module 301 is connected to a module 601 for generating the trajectory of the movable member, communicating in turn with the position adjustment module 501; moreover, a module 401 stores the predefined position and current values. The real position data, which are supplied by the sensor 901, allow, via the position adjustment module 501, definition of the reference value for the current regulation module 701.

The real current data, supplied by the power supply section 801 connected to the power supply input 201, can be used, by the current regulation module 701, to control the current flowing in the two magnets. The module 101, by means of the position data which are supplied by the sensor 901 and by the trajectory generator 601, manages the reference value of the current regulation module 701 by means of the selection module 311.

The actuator 2 is connected to the chamber 10 of the compressor opposite the valve seat 12 and comprises a movable member 302, in the example shown a rod, which has at one end an element 322 in the form of fingers able to act on the obturator 11 of the valve and at the opposite end co-operates with the position sensor 901 connected to the microprocessor 1. The movable member is provided with a magnetisable radial plate 312 arranged between two solenoids 102 and 202 which are both interfaced with the power supply section 801 of the microprocessor 1.

FIG. 2 illustrates schematically the steps of the method according to the present invention; in the figure, the lines 20, 21 along the X-axis both represent the time intervals, while the curve 22 is the curve for the current which flows through the magnet 202, the curve 23 is the curve for the current in the magnet 102, and the curve 24 is the curve for the position of the movable member 302. The various steps, indicated by the letters a to h, are illustrated symbolically by the diagrams numbered 30 to 37, showing the positions assumed by the magnetisable plate 312 of the movable member 302 with respect to the two magnets 102, 202. Below all the steps of the method according to the invention are analysed.

a) Opening release: control of the power supply voltages of the two electromagnets is dependent upon the reference current set: in the top electromagnet said current will be negative, while in the bottom electromagnet it will be positive. The transition to the next step takes place when the movable part passes through a predefined position. Essentially, in this step the magnets 102, 202 are energised and the positions are those shown by the diagram 30; the step terminates when the magnetisable plate 312 is separated from the magnet 102.

b) Current-controlled opening: control of the power supply voltages of the two electromagnets is dependent upon the reference current set: in the top electromagnet said current will be zero, while in the bottom electromagnet it will be positive. The transition to the next step takes places when the magnetisable plate passes through a predefined position, in the region of the equilibrium position.

c) Position-controlled opening: control of the power supply voltage of the top electromagnet is dependent upon the reference current set. Control of the power supply voltage of the bottom electromagnet is dependent upon the reference current supplied by the position controller; as can be noted, the current in the bottom electromagnet decreases as the magnetisable plate approaches the same bottom magnet.

The transition to the next step takes place when the movable part passes through a predefined position which, as can be seen from the diagram 32, is the position in which the magnetisable plate and the bottom magnet are in contact with each other.

d) Retention in open position: control of the power supply voltage of the top electromagnet is dependent upon the reference current set. Control of the power supply voltage of the bottom electromagnet is dependent upon the reference current supplied by the position controller. The transition to the next step takes place when the time set in the control unit is exceeded. It should be noted that this step may be prolonged as required in terms of duration by means of input of an opening signal from the microprocessor module 101. The procedure will be resumed when the appropriate command is entered.

e) Closure release: control of the power supply voltages of the two electromagnets is dependent upon the reference current set: in the top electromagnet said current will be positive, while in the bottom electromagnet it will be negative. As can be seen from the diagram 34 and the curves 22 and 23, this step is substantially the opposite of the step a, with the current at the two magnets substantially reversed. The transition to the next step takes place when the movable part passes through a predefined position which coincides with separation of the movable part from the bottom magnet.

f) Current-controlled closure: control of the power supply voltages of the two electromagnets is dependent upon the reference current set: in the bottom electromagnet said current will be zero, while in the top electromagnet it will be positive. The transition to the next step takes place when the movable part passes through a predefined position. This step is substantially a mirror-image of the step b, as can be noted both from the diagram 35 and from the curves 22, 23 and 24.

g) Position-controlled closure: control of the power supply voltage of the bottom electromagnet is dependent upon the reference current set. Control of the power supply voltage of the top electromagnet is dependent upon the reference current supplied by the position controller. The transition to the next step takes place when the movable part passes through a predefined position. Similarly to that described for step c, in this step also the magnetisable plate 312 moves towards the top magnet 102 until it comes into contact therewith, while the current which flows through the same magnet decreases with the approaching movement of the said plate.

h) Retention in closed position: control of the power supply voltage of the bottom electromagnet 202 is dependent upon the reference current set. Control of the power supply voltage of the bottom electromagnet is dependent upon the reference current supplied by the position controller. The transition to the step a) takes place when the positioning execution signal changes.

In order to increase the repeatability of the system, eliminating the influence of the residual induction, the position control method is moreover characterized by a current input which does not alter the mechanical dynamics of the system. Said current input is activated when the movable part is sufficiently removed from the electromagnet concerned; as can be seen from the graph in FIG. 2, during the transition between the steps c and d and between the steps g and h, respectively, the magnet opposite to that in contact with the magnetisable plate 312, i.e. in the first case the top magnet 102 and in the second case the bottom magnet 202, are subject to a highly negative current for a given time interval, as indicated by the two peaks 230 and 220, respectively.

More generally, it may be stated that, when the distance of the movable member from an electromagnet is greater than a given value, a negative reference current is applied to the said electromagnet for a given time interval.

The method according to the present invention is conveniently implemented, in the form of a suitable program in the module 301 of the microprocessor 1 and this program processes the data by means of a position control loop, having as an input the reference position, generated by the trajectory generator 601, and the real position, detected by the sensor 901, and by means of a current control loop, having as an input the reference current, resulting from the predefined values 401 or at the output of the position module, and the real current, detected by means of the detector 811, so as to return suitable output signals able to control the forces generated by the two electromagnets 102, 202 according to a given trajectory.

The invention claimed is:

1. Method for controlling the position of an electromechanical actuator for reciprocating compressor valves, said actuator comprising a member movable in a direction parallel to the direction for opening and closing of the obturator of said valve, between a position corresponding to the closed position and a position corresponding to the open position of said obturator, said member being provided with an element arranged to act on the said obturator and with a magnetisable portion co-operating with two electromagnets and being arranged in equilibrium between the two electro-magnets, said method comprising the following operational steps:

a) release for opening: energizing the magnets so as to allow separation of the portion of the movable member from the magnet directed away from the said valve and cause its displacement towards the other magnet;

b) current-controlled opening: moving the movable member, as a result of the action of the magnets, towards the position for opening the obturator of the valve;

c) position-controlled opening: regulating the current in the magnets so as to brake the movable member during the final section of its stroke;

d) retention in open position: retaining the movable member in the position for opening the valve obturator for a given time interval;

e) release for closure: energizing the magnets so as to allow separation of the movable member portion from the magnet directed towards said valve and cause its displacement towards the other magnet;

f) current-controlled closing: moving the movable member, as a result of the action of the magnets, towards the position for closing the obturator of the valve;

g) position-controlled closing: regulating the current in the magnets so as to brake the movable member during the final section of its stroke; and h) retention in closed position: retaining the movable member in the position for closing the obturator of the valve until a new transition signal is generated, for execution of step a) again;

the method being carried out by using a processing unit connected to a sensor for detecting the position of the movable member of the said actuator and a detector for detecting the strength of the current flowing in the two said magnets, said processing unit comprising a module for inputting the enable and start-up and opening signals, a non-volatile memory module storing the program for processing the data acquired and the predefined reference values, a module for generating the trajectory of the said movable member, a module for adjusting the position of the said movable member, a module for regulating the current which controls a power supply section connected to a power supply input and interfaced with the detector for detecting the strength of the current flowing in the said magnets.

2. Method according to claim 1, wherein when the distance of the movable member from an electromagnet is greater than a given value, a negative reference current is applied to the said electromagnet for a given time interval.

3. Method according to claim 1 wherein the step a) is performed by imparting to the magnet directed away from the said valve a negative reference current and a positive reference current to the other magnet.

4. Method according to claim 1 wherein the step b) is performed by imparting to the magnet directed away from the said valve a zero reference current and to the other magnet a positive reference current.

5. Method according to claim 1 wherein the step c) is performed by imparting to the magnet directed away from the said valve a zero reference current and to the other magnet a reference current which varies with the distance of the magnetisable portion of the said movable member from the said magnet.

6. Method according to claim 1 wherein the step e) is performed by imparting to the magnet directed towards the said valve a negative reference current and to the other magnet a positive reference current.

7. Method according to claim 1 wherein the step f) is performed by imparting to the magnet directed towards the said valve a zero reference current and to the other magnet a positive reference current.

8. Method according to claim 1 wherein the step g) is performed by imparting to the magnet directed towards the said valve a zero reference current and to the other magnet a reference current which varies with the distance of the magnetisable portion of the said movable member from the said magnet.

9. Method according to claim 1, wherein said program processes the data with of a position control loop having as an input the reference position, generated by the trajectory generator, and the real position, detected by the detector, and with a current control loop, having as an input the reference current, resulting from the predefined values or from the output of the position module, and the real current, detected by means of the detector, so as to return suitable output signals able to control the forces generated by the two electromagnets according to a given trajectory.

* * * * *